US007150651B1

(12) United States Patent
Yuan et al.

(10) Patent No.: US 7,150,651 B1
(45) Date of Patent: Dec. 19, 2006

(54) RECEPTACLE CONNECTOR

(75) Inventors: Sheng-Tsung Yuan, Tu-Cheng (TW); Yu-Hung Su, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/384,782

(22) Filed: Mar. 21, 2006

(51) Int. Cl.
*H01R 13/648* (2006.01)

(52) U.S. Cl. ..... 439/607

(58) Field of Classification Search ..... 439/607, 439/79

See application file for complete search history.

(56) References Cited

U.S. PATENT DOCUMENTS 6,475,033 B1 * 11/2002 Zhu et al. ..... 439/607
6,503,102 B1 * 1/2003 Zhang et al. ..... 439/607
2001/0016453 A1 * 8/2001 Casey et al. ..... 439/607

* cited by examiner

*Primary Examiner*—Tho D. Ta
(74) *Attorney, Agent, or Firm*—Rosenberg, Klein & Lee

(57) ABSTRACT

A receptacle connector includes a receptacle housing having a receptacle base, a lingulate board extending forward from the receptacle base, a plurality of terminal recesses formed on the receptacle base and extending into the lingulate board, and a guide recess adjoining the terminal recesses disposed in the receptacle base lengthwise and crossing through the receptacle base; a plurality of electrical terminals received in the terminal recesses; a receptacle shelter enclosing the outside of the receptacle housing. A guide slice is disposed on the bottom surface of the receptacle shelter. The guide slice is adapted to mate with and insert into the guide recess of the receptacle base.

5 Claims, 3 Drawing Sheets

RECEPTACLE CONNECTOR

BACKGROUND OF THE INVENTION

1. Field of the Invention

The present invention generally relates to a receptacle connector, and more particular to a receptacle connector having a receptacle housing and a receptacle shelter for assembling the receptacle shelter with the receptacle housing securely and conveniently.

2. The Related Art

At present, USB (Universal Serial Bus; USB) connector has some characteristics such as plug-and-play, hot-plugging, high speed transmission and so on. So that the USB connector is widely applied in the consuming electrical products, such as digital camera, mobile phone and so on.

In general, a conventional USB receptacle connector includes an insulating housing, a plurality of electrical terminals and a metal shell. The insulating housing has a receptacle base and a lingulate board extending forward from the receptacle base. The electrical terminals are mounted on the receptacle base and extend into the lingulate board. The metal shell has elastic buckling force and encloses the outside of the receptacle base tightly by the elastic buckling force.

It can be seen that the above-mentioned receptacle connector does not have guide mechanism on the insulating housing and the metal shell. It is not convenient for assembling the metal shell with the insulating housing quickly. After assembling, the metal shell encloses the receptacle base only by the elastic buckling force of the metal shell. When the metal shell is used repeatedly, it is easy to slack between the metal shell and the insulating housing.

SUMMARY OF THE INVENTION

It is an object of the present invention to provide a receptacle connector which includes a receptacle housing having a receptacle base, a lingulate board extending forward from the receptacle base, a plurality of terminal recesses formed on the receptacle base and the lingulate board, a guide recess adjoining the terminal recesses and disposed in the receptacle base lengthwise and crossing through the receptacle base, a plurality of electrical terminals received into the terminal recesses of the receptacle housing, and a receptacle shelter enclosing the outside of the receptacle housing. A guide slice is disposed on the bottom surface of the receptacle shelter. The guide slice is adapted to mate with and insert into the guide recess of the receptacle base.

It can be seen that the guide slice of the receptacle shelter is adapted to mate with and insert into the guide recess of the receptacle housing. Therefore, it is convenient to guide the receptacle shelter to firmly assemble with the receptacle housing.

Other objects, novel features and advantages of the present invention will become more apparent from the following detailed description of a preferred embodiment thereof when taken in conjunction with the accompanying drawings.

DETAILED DESCRIPTION OF THE PREFERRED EMBODIMENT

In order to illustrate the present invention particularly, including technology, structure traits, aims and efficiency, a detailed explanation of a preferred embodiment of the present invention will be given thereinafter, with reference to the annexed drawings, for better understanding thereof to those skilled in the art.

Figure 1:
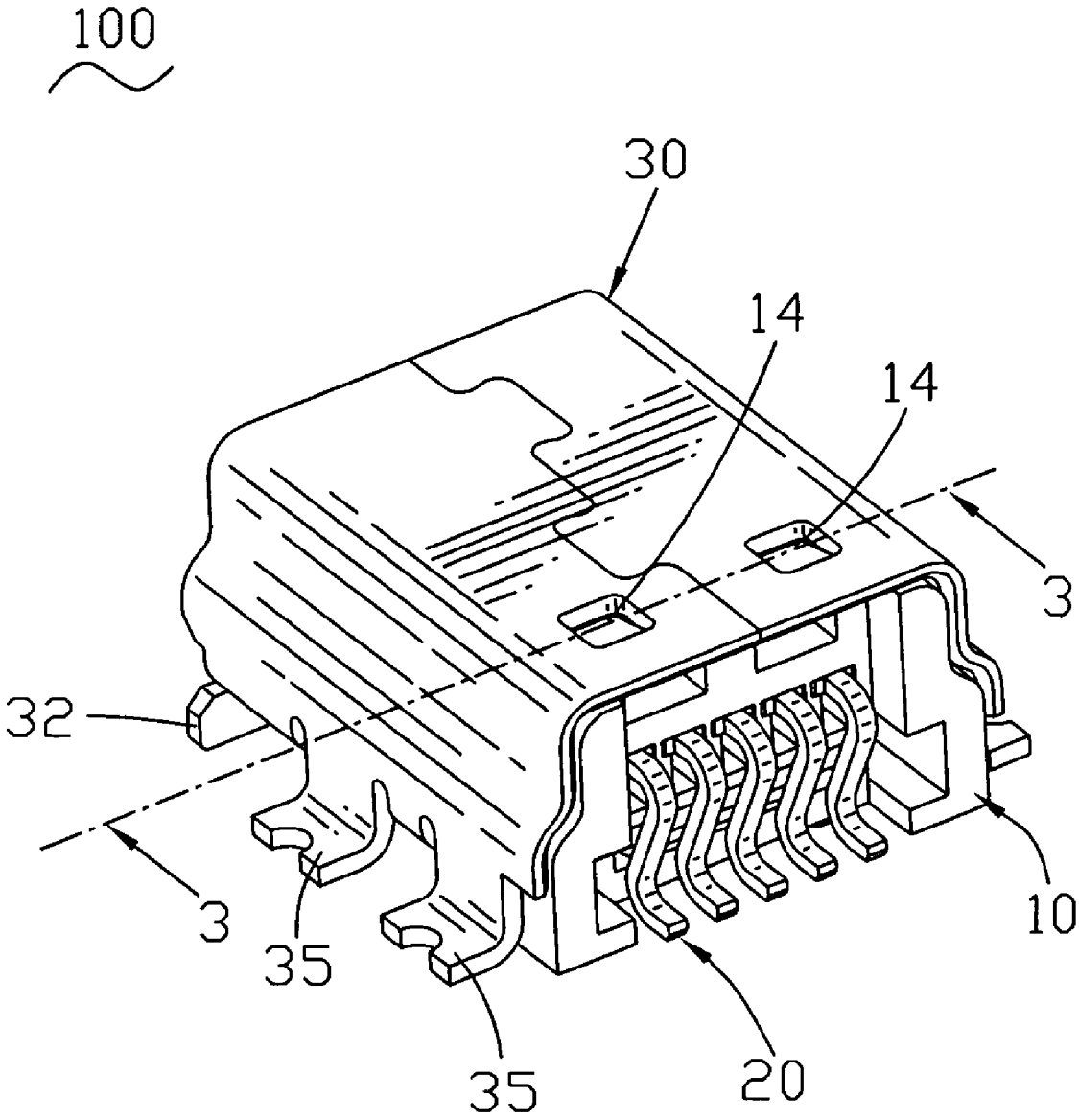
FIG. 1 is a perspective view of a receptacle connector in accordance with the present invention.

FIG. 1 illustrates a receptacle connector 100 of this invention. The receptacle connector 100 is an USB receptacle connector including a receptacle housing 10, a plurality of electrical terminals 20 received in the receptacle housing 10 and a receptacle shelter 30 enclosing the outside of the receptacle housing 10.

Figure 2:
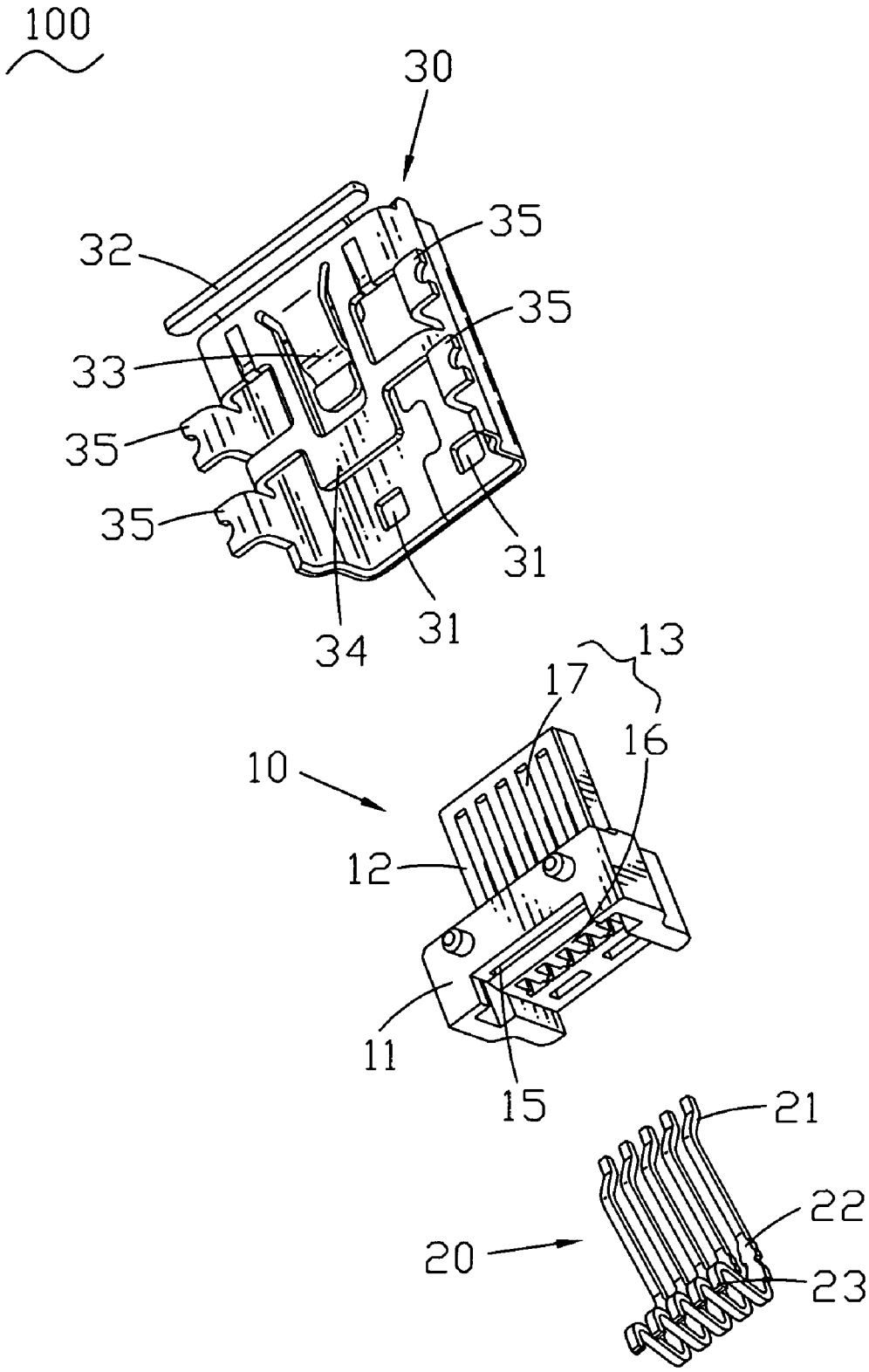
FIG. 2 is an exploded perspective view of the receptacle connector shown in FIG. 1.

Referring to FIG. 2, the receptacle housing 10 has a receptacle base 11 and a lingulate board 12 extending forward from the receptacle base 11. A plurality of terminal recesses 13 are formed in the receptacle base 11 and the lingulate board 12 for receiving the electrical terminals 20. Each terminal recess 13 has a rear portion 16 which is located in the receptacle base 11 and go through thereof, and a front portion 17 which is located in the lingulate board 12 and communicates with the rear portion 16 and the bottom surface of the lingulate board 12. Two wedge protrusions 14 are disposed on the top surface of the receptacle base 11 (as shown in FIG. 1). A guide recess 15 is lengthwise disposed in the receptacle base 11 adjacent to and under the terminal recesses 13 and crosses through the receptacle base 11.

Each electrical terminal 20 has a contact end 21, an interference portion 22 and a soldering end 23. The contact end 21 extends forward from the interference portion 22, and the soldering end 23 is bent downward from the interference portion 22.

Two openings 31 are formed on the top surface of the receptacle shelter 30 and correspond to the wedge protrusions 14 respectively. The receptacle shelter 30 forms a rim 32 at the front of the bottom of the receptacle shelter 30. The rim 32 extends downwardly. A spring arm 33 is located on the middle part of the bottom of the receptacle shelter 30. A guide slice 34 adjacent to the spring arm 33 is disposed on the bottom of the receptacle shelter 30, and the guide slice 34 extends forwardly. A plurality of solders 35 are protruded from the laterals of the receptacle shelter 30.

Figure 3:
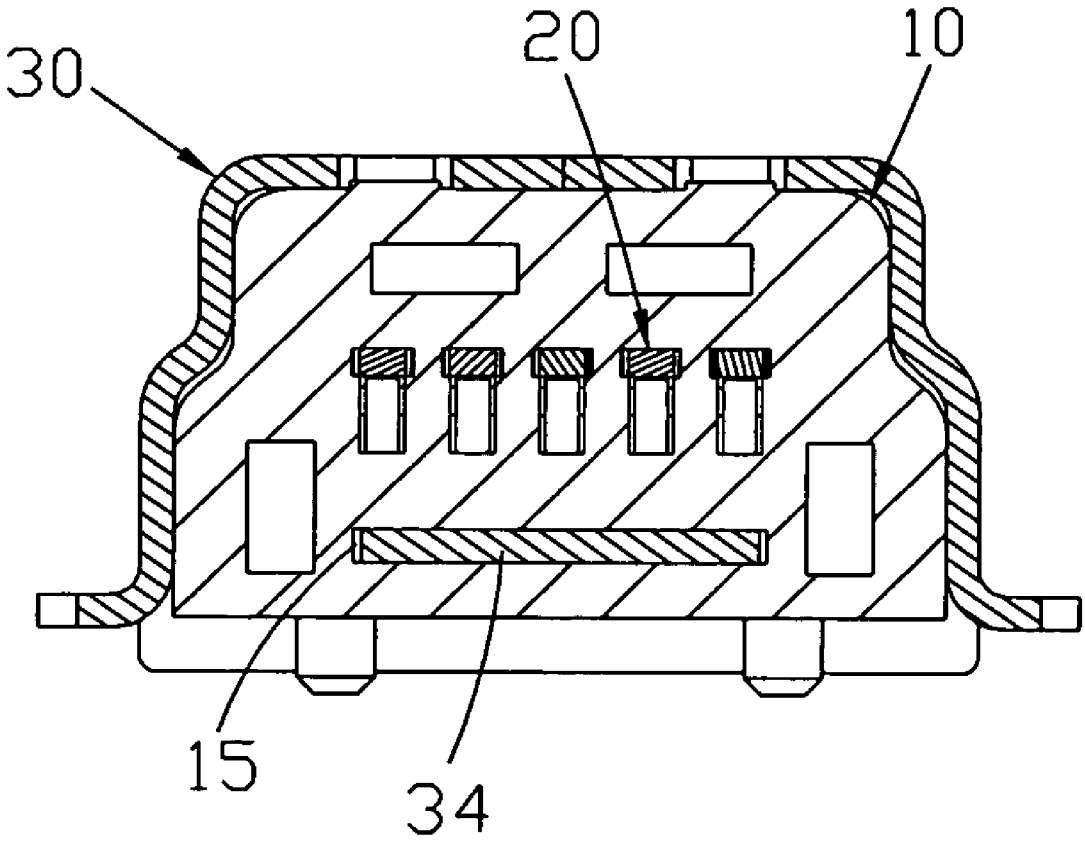
FIG. 3 is a cross-sectional view taken along line 3—3 of FIG. 1.

Further referring to FIGS. 1 to 3, when assembling the receptacle connector 100 of the invention, firstly, the contact end 21 of each electrical terminal 20 is inserted into the receptacle base 11 from the rear portion 16 of the terminal recess 13 and extends into the lingulate board 12. The electrical terminals 20 are protruded downwardly. The soldering end 23 of each electrical terminal 20 is exposed on the rear portion 16 of the receptacle housing 10, and then, the guide slice 34 of the receptacle shelter 30 is adapted to mate with and insert into the guide recess 15 of the receptacle housing 10. Therefore the receptacle shelter 30 encloses the receptacle housing 10 securely.

It can be seen that in the course of assembling, the guide slice 34 of the receptacle shelter 30 is adapted to mate with and insert into the guide recess 15 of the receptacle housing 10. So it is convenient to guide the receptacle shelter 30 to firmly assemble with the receptacle housing 10.

Although a preferred embodiment of the present invention has been described in detail hereinabove, it should be clearly understood that many variations and/or modifications of the basic inventive concepts herein taught which may appear to those skilled in the present art will fall within the spirit and scope of the present invention, as defined in the appended claims.

What is claimed is:

1. A receptacle connector comprising:

a receptacle housing having a receptacle base, a lingulate board extending longitudinally forward from the receptacle base, a plurality of terminal recesses each respectively formed in the receptacle base in a linear relationship one with another across a length of said receptacle base, each of said terminal recesses extending longitudinally into the lingulate board, said receptacle housing including a guide recess formed as a lateral slot below said terminal recesses in said receptacle base and extending laterally across said length defined thereby;

a plurality of electrical terminals respectively received in said terminal recesses of the receptacle housing; and a receptacle shelter enclosing the outside of the receptacle housing, said receptacle shelter having a spring arm formed only on a bottom surface thereof such that a top surface of said receptacle shelter is free from having a spring arm formed thereon, said receptacle shelter having a guide slice disposed on the bottom surface thereof adjacent said spring arm, said guide slice inserted into said guide recess of said receptacle base.

2. The receptacle connector as claimed in claim 1, wherein said guide recess passes longitudinally through the receptacle base.

3. The receptacle connector as claimed in claim 1, wherein each terminal recess has a rear portion which is located in the receptacle base and extending longitudinally therethrough, and a front portion which is located in the lingulate board and communicates with the rear portion and the bottom surface of the lingulate board.

4. The receptacle connector as claimed in claim 1, wherein said receptacle shelter includes a rim formed at the front of the bottom of the receptacle shelter and said rim extends downwardly.

5. The receptacle connector as claimed in claim 1, wherein said receptacle connector is an USB receptacle connector.

* * * * *